US008368614B2

(12) United States Patent
Inoue et al.

(10) Patent No.: US 8,368,614 B2
(45) Date of Patent: Feb. 5, 2013

(54) ANTENNA APPARATUS AND WIRELESS COMMUNICATION DEVICE

(75) Inventors: Kazuhiro Inoue, Tokyo (JP); Makoto Higaki, Kawasaki (JP); Akiko Yamada, Yokohama (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 564 days.

(21) Appl. No.: 12/623,749

(22) Filed: Nov. 23, 2009

(65) Prior Publication Data

US 2010/0127943 A1 May 27, 2010

(30) Foreign Application Priority Data

Nov. 25, 2008 (JP) ..... 2008-299921

(51) Int. Cl.
*H01Q 15/02* (2006.01)

(52) U.S. Cl. ..... 343/909; 343/700 MS; 343/793; 343/846

(58) Field of Classification Search ..... None
See application file for complete search history.

(56) References Cited

U.S. PATENT DOCUMENTS 6,262,495 B1 7/2001 Yablonovitch et al.
6,476,771 B1 * 11/2002 McKinzie, III ..... 343/756
6,552,689 B2 * 4/2003 Shinichi ..... 343/702
2003/0142036 A1 7/2003 Wilhelm et al.
2004/0075617 A1 * 4/2004 Lynch et al. ..... 343/909
2005/0134522 A1 6/2005 Waltho
2006/0187126 A1 * 8/2006 Sievenpiper ..... 343/700 MS
2008/0150825 A1 6/2008 Higaki et al.
2008/0284674 A1 * 11/2008 Herz et al. ..... 343/909
2009/0040112 A1 2/2009 Sekine et al.
2009/0079654 A1 3/2009 Higaki et al.
2009/0140929 A1 6/2009 Inoue et al.

FOREIGN PATENT DOCUMENTS

JP 3653470 3/2005

OTHER PUBLICATIONS

U.S. Appl. No. 12/485,377, filed Jun. 16, 2009, Akiko Yamada, et al.
U.S. Appl. No. 12/410,768, filed Mar. 25, 2009, Tomohiro Suetsuna, et al.
U.S. Appl. No. 12/351,235, filed Jan. 9, 2009, Makoto Higaki, et al.
Japanese Office Action issued Jun. 19, 2012 in Patent Application No. 2008-299921 with English Translation.

* cited by examiner

*Primary Examiner* — Trinh Dinh
(74) *Attorney, Agent, or Firm* — Oblon, Spivak, McClelland, Maier & Neustadt, L.L.P.

(57) ABSTRACT

An antenna apparatus includes: a ground plane; a plurality of conductive elements arranged substantially in parallel to a surface of the ground plane; a plurality of linear elements configured to connect the conductive elements to the ground plane; and an antenna configured to radiate a radio wave, wherein a plurality of openings to reflect the radio wave radiated from the antenna are formed in the ground plane under an arrangement region of the conductive elements.

16 Claims, 15 Drawing Sheets

ANTENNA APPARATUS AND WIRELESS COMMUNICATION DEVICE

CROSS REFERENCE TO RELATED APPLICATIONS

This application is based upon and claims the benefit of priority from the prior Japanese Patent Application No. 2008-299921, filed on Nov. 25, 2008, the entire contents of which are incorporated herein by reference.

BACKGROUND OF THE INVENTION

1. Field of the Invention

The present invention relates to an antenna apparatus and a wireless communication device, and especially, relates to an antenna apparatus using a high-impedance substrate, and a wireless communication device provided with the antenna apparatus.

2. Related Art

An EBG (Electromagnetic Band Gap) is known as a technology for placing a metal plate (a ground plane) in the vicinity of an antenna in order to thin an antenna apparatus (refer to the specification of U.S. Pat. No. 6,262,495 and Japanese Patent No. 3653470). The EBG substrate is constituted such that conductive elements (plate-shaped elements) are arranged in a matrix pattern at a certain height on the metal plate and each of the plate-shaped elements is connected to the metal plate by use of a linear element. This EBG substrate forms an LC parallel resonance circuit by use of a distribution constant circuit, thereby implementing high impedance and suppressing unnecessary current distribution which occurs on the metal plate.

When the EBG substrate is adopted in usage intended to thin the antenna apparatus, important are to place the antenna in the vicinity of the EBG substrate and to thin the EBG substrate itself. As to the thinning of the EBG substrate itself, band characteristics of the EBG substrate are known to be proportional to the thickness of the substrate, and merely a thinning of the substrate leads to narrow-banding, resulting in a lack of a band from a practical standpoint. The thinning, thus, has its own limits. In the EBG substrate described in the specification of U.S. Pat. No. 6,262,495 and Japanese Patent No. 3653470, the EBG substrate becomes thick in, for example, a frequency/band of a cellular phone (about 6 mm or more in 800 MHz, about 2.5 mm or more in 2 GHz), and it is not possible to implement an ultimate thinning of the entire antenna including the EBG substrate viewed from a ground face.

Additionally, there is another problem, which occurs in thinning the EGB substrate, that if the thickness of a high-impedance substrate is becoming thinner while retaining an operational frequency, increased is a size of unit cells periodically arranged in the high-impedance substrate (in other words, the size of each plate-shaped element is increased). A low profile of the antenna requires the unit cells having the number corresponding to the low profile, and thus, an increase in size of the unit cell leads to an enlargement of an area of the substrate.

Further, when the high-impedance substrate is downsized using a dielectric body, there is a problem such as that the band characteristics of the substrate are band-narrowed. Moreover, there is a problem such as that a trouble occurs in curving a surface of the ground plane constituting the high-impedance substrate.

SUMMARY OF THE INVENTION

According to an aspect of the present invention, there is provided with an antenna apparatus comprising: a ground plane; a plurality of conductive elements arranged substantially in parallel to a surface of the ground plane; a plurality of linear elements configured to connect the conductive elements to the ground plane; and an antenna configured to radiate a radio wave, wherein a plurality of openings to reflect the radio wave radiated from the antenna are formed in the ground plane under an arrangement region of the conductive elements.

According to an aspect of the present invention, there is provided with an antenna apparatus comprising: a ground plane; a plurality of conductive elements arranged substantially in parallel to a surface of the ground plane; a plurality of linear elements configured to connect the conductive elements to the ground plane; and an antenna configured to radiate a radio wave, wherein a plurality of openings to reflect the radio wave radiated from the antenna toward the ground plane are formed in each of the conductive elements.

According to an aspect of the present invention, there is provided with wireless communication device, comprising: an antenna apparatus according to the aspect or the another aspect of the present invention; a feeding line connected to a feeding point of the antenna in the antenna apparatus; a wireless circuit configured to supply a high frequency current to the antenna via the feeding line.

DETAILED DESCRIPTION OF THE INVENTION

Figure 1:
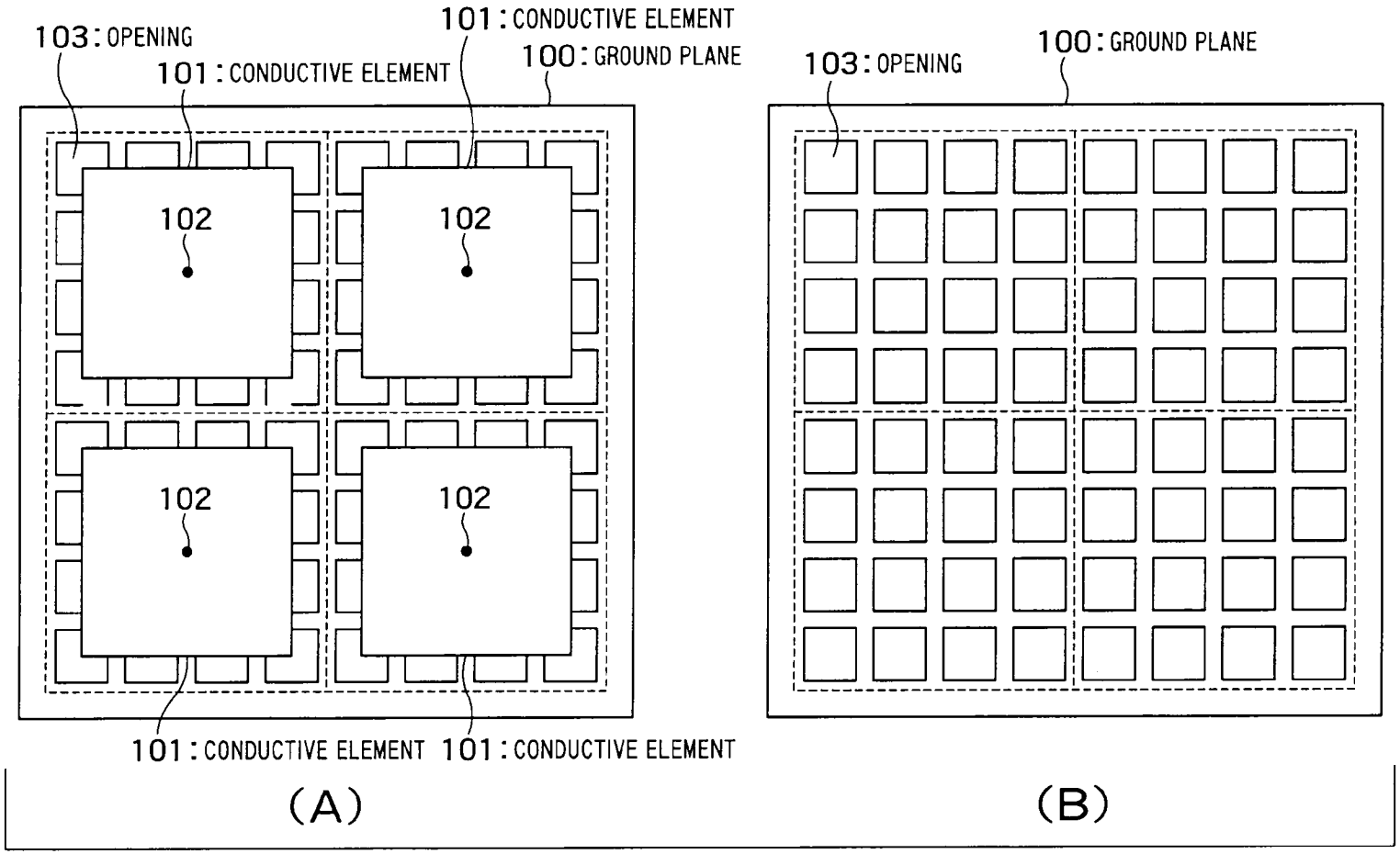
FIG. 1 is a diagram showing a configuration of a high-impedance substrate according to a first embodiment.

Embodiments according to the present invention will now be explained with reference to the accompanying drawings.

(First Embodiment)

FIG. 1(A) is a top diagram showing a configuration of a high-impedance substrate according to a first embodiment of the present invention. FIG. 1(B) is a diagram in which a ground plane of the high-impedance substrate in FIG. 1(A) is taken out and shown. FIG. 2 is a side diagram of the high-impedance in FIG. 1A.

Plate-shaped conductive elements 101 are arranged in a matrix pattern at a certain height from a finite ground plane (ground plane) 100. Here, the matrix of two rows×two columns is formed. However, the present application is not limited to the two rows×two columns, and includes a matrix formed by n rows×m columns using integers n, m equal to or more than 2. The conductive element 101 has, for example, a two-dimensionally rectangular shape, and here, has a square shape.

A surface of each conductive element 101 is substantially parallel to the ground plane 100. Each conductive element 101 is connected, at its center, to the ground plane 100 via a linear element 102. A connection position between the conductive element 101 and the linear element 102 may not be the center of the conductive element 101, and be an arbitrary position depending on desired communication characteristics.

A length h of the linear element 102 is extremely shorter than a use wavelength $\lambda$ ($h \ll \lambda$). As shown in FIG. 2, a parallel resonance circuit is formed by combining a floating capacitor between the adjacent conductive elements 101 with a floating inductor of the linear element 102 and the parallel resonance circuits are periodically arranged, thereby making an entire of the ground plane high-impedance.

A sum of the length of one side of the conductive element 101 and that of the linear element 102 is adjusted so as to be the length substantially equal to a one-quarter wavelength of an operational frequency. This one-quarter wavelength means an electrical length. The length as the one-quarter wavelength changes depending on a medium placed near the conductive element 101, a distance between the conductive elements 101, or a distance between the conductive element 101 and the ground plane 100 or the like.

Here, in the ground plane 100, openings are formed in a mesh pattern in an arrangement region of the conductive element 101. This is significantly different from a conventional art. By forming the openings in the ground plane in the mesh pattern, an electromagnetic near field radiated from an antenna (refer to FIGS. 12A to 15B all of which will be explained later on) swells out from a mesh of the ground plane 100, whereby the thickness of the high-impedance substrate is electromagnetically seen to be effectively thick, which can implement a structural thinning of the substrate. However, the openings are not necessarily formed in the mesh pattern, and as long as the openings are plurally formed in the arrangement region of the conductive element 101, an effect of the present embodiment can be obtained.

Figure 2:
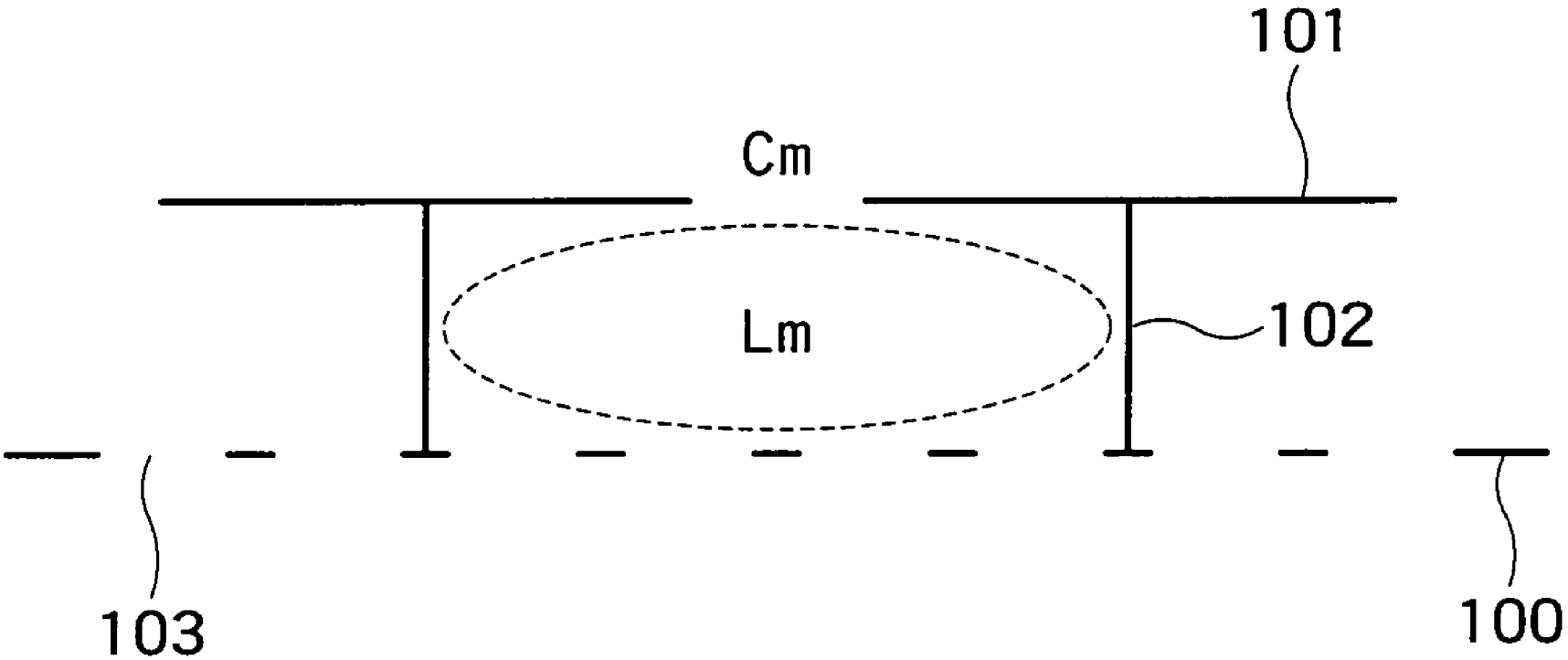
FIG. 2 is a side diagram of the high-impedance in FIG. 1.
Figure 3:
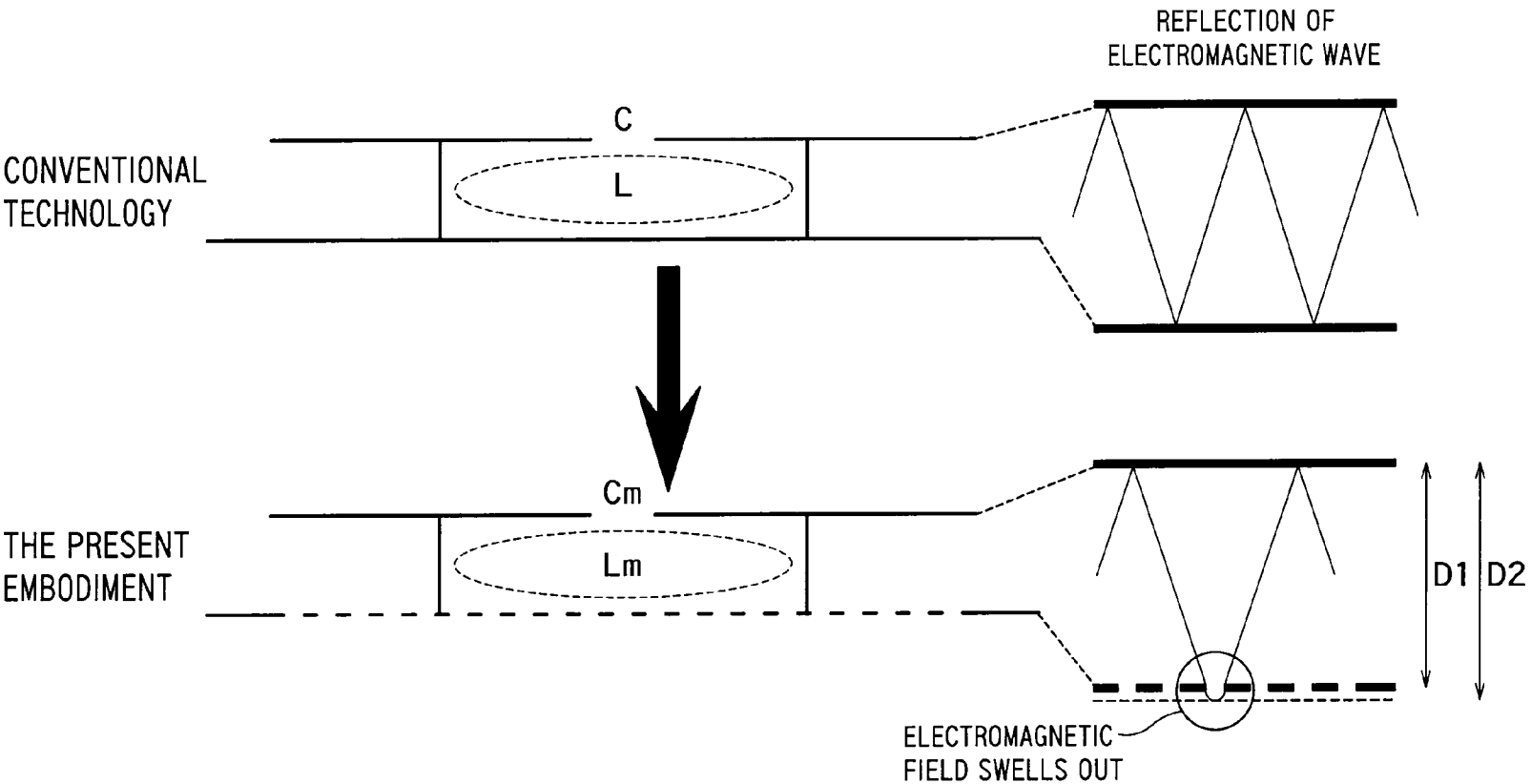
FIG. 3 is a diagram schematically showing a swell-out phenomenon of an electromagnetic field in openings formed in a ground plane in a mesh pattern.

It is to be noted that the arrangement region of the conductive element 101 in the ground plane cited here means a region including a region where the ground plane and the conductive element 101 are overlapped with each other when viewed from a direction perpendicular to the ground plane (each of portions surrounded by dotted lines in FIG. 1). FIG. 3 is a diagram schematically showing a swell-out phenomenon of the electromagnetic field in the openings formed in the mesh pattern.

If the high-impedance substrate is fabricated extremely thinly compared with the use wavelength, the ground plane and the conductive element are opposed to each other at a distance in the extreme vicinity, compared with the use wavelength. An electromagnetic wave reflecting therebetween repeats reflections on the surface of the ground plane if the ground plane is solid as conventional one, however, when the meshed openings are formed in the metal plate, observed is the phenomenon in which reflection points equivalently swell out to an outside of the openings. The distance between the opposed two metal plates (distance between the ground plane and the conductive element) is extremely shorter than the wavelength, so that a phase shift amount of the electromagnetic wave due to this swell-out becomes in a significant amount, compared with that of propagation between reflection points, and the thickness between the metal plates is seen as if it equivalently became thick. Specifically, an actual width D1 is seen to have become thick to a width D2. The swell-out of the electromagnetic near field in the meshed openings is dependent on the size of the opening itself and a density of the openings. However, in order to effectively reflect the electromagnetic wave, the size of the opening is more reduced than that of the conductive element 101. Additionally, if the distance between the opposed metal plates becomes short, an effect of a phase shift of the electromagnetic wave due to the swell-out of the electromagnetic field becomes relatively larger.

Figure 4:
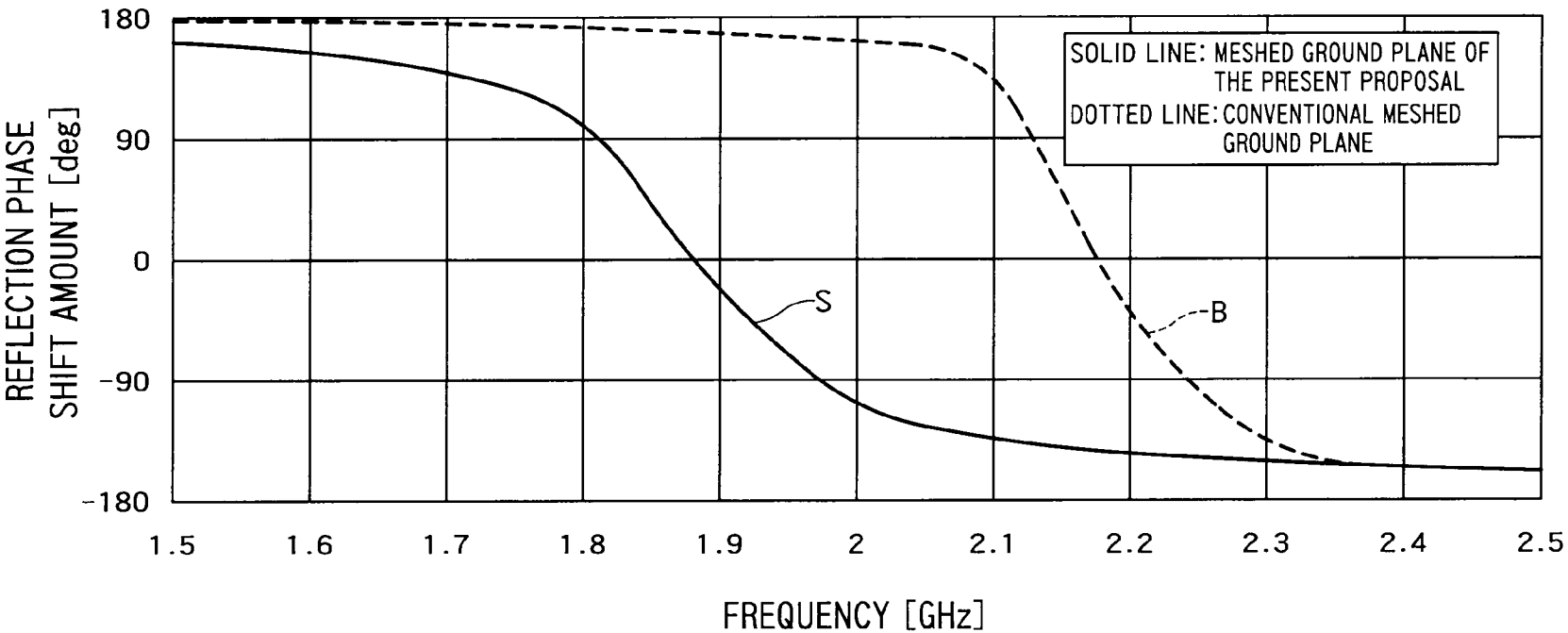
FIG. 4 is a graph created on the basis of a result from an electromagnetic field simulation which the present inventors have uniquely performed for actually confirming an effect of the high-impedance substrate in FIG. 1.

FIG. 4 is a graph created on the basis of a result from an electromagnetic field simulation which the present inventors have uniquely performed for actually confirming the effect of the high-impedance substrate in FIG. 1A. This graph shows frequency characteristics of a reflection phase shift amount of a planar electromagnetic wave vertically incoming toward the high-impedance substrate in FIG. 1A. A solid line S in the FIG. 4 indicates the characteristics of the high-impedance substrate where the meshed openings are formed in the ground plane according to the present embodiment, whereas a dotted line B indicates the characteristics of the high-impedance substrate using the conventional solid ground plane. Here, a transverse axis is a frequency [GHz], whereas a longitudinal axis is the reflection phase shift amount [deg].

It is known that an EBG substrate implementing the high-impedance substrate has a correlation between a band gap frequency indicative of the high-impedance characteristics and the reflection phase shift amount, and there are some stances for considering that the EBG substrate operates within the range of 0±90 degrees or 90±45 degrees of the reflection phase shift amount. Whichever range is used for evaluation, it turns out that a forming of the meshed openings results in a lowered frequency, and that the solid line S according to the present embodiment is spread more widely in a lateral direction compared with the conventional dotted line B, and that a band is broadened. Therefore, in the same operational frequency, the present embodiment allows the EBG substrate to be more downsized than the conventional one, and in the same thickness, the present embodiment enables to implement the EGB substrate whose band is more broadened (in other words, thinned in the same frequency band) than the conventional one.

As described above, the present embodiment allows the high-impedance substrate to be downsized, and the band to be broadened (thinned) by forming the openings in the mesh pattern in the ground plane constituting the high-impedance substrate. In addition, bending property of the high-impedance substrate is improved by forming the ground plane in the mesh pattern, so that it is possible to curve the surface of the high-impedance substrate.

(Second Embodiment)

Figure 5:
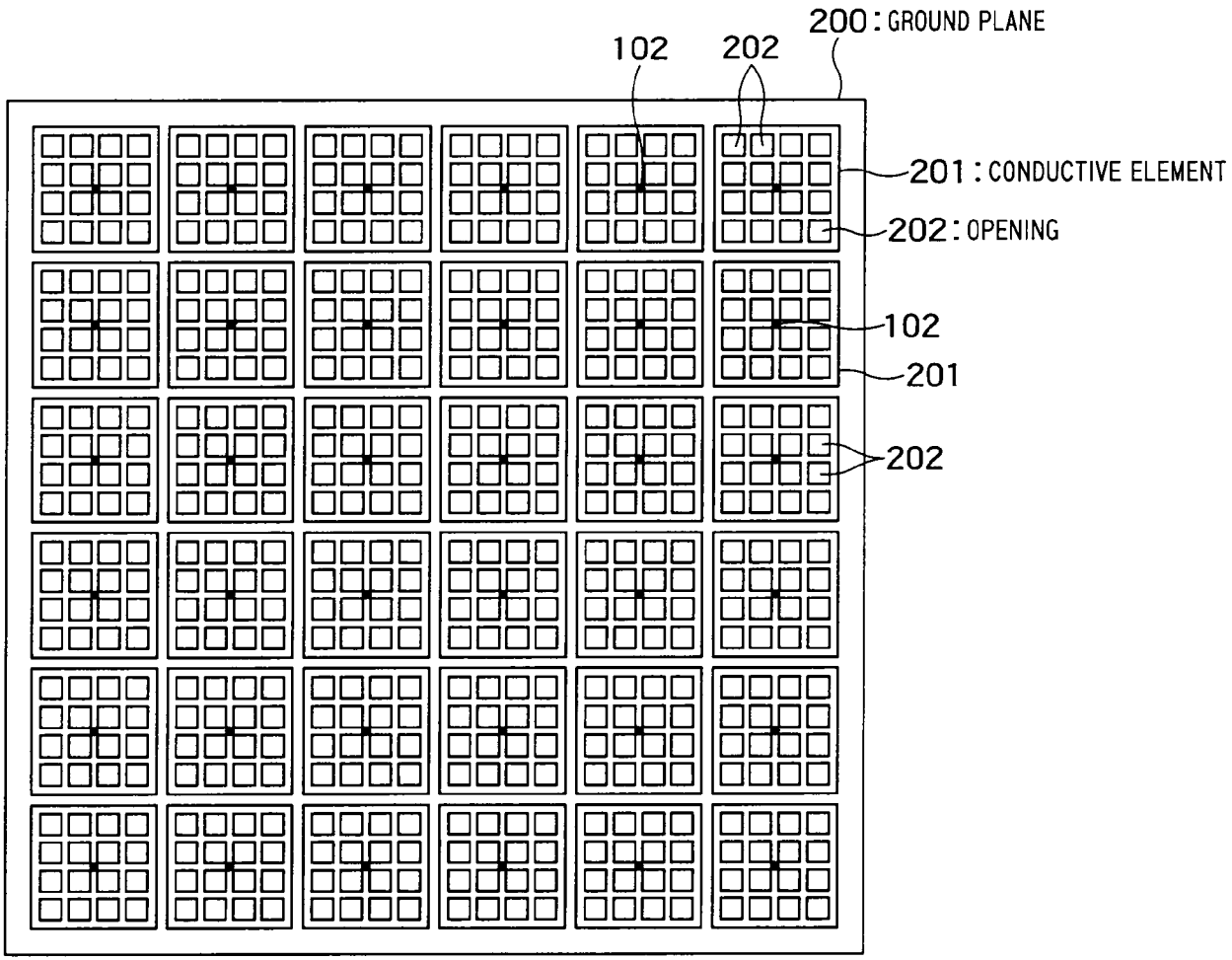
FIG. 5 is a top diagram showing a configuration of a high-impedance substrate according to a second embodiment.

FIG. 5 is a top diagram showing a configuration of a high-impedance substrate according to a second embodiment of the present invention.

Points largely different from the first embodiment are that openings 202 for reflecting the electromagnetic wave reflected on a ground plane 200 toward the ground plane 200 are formed in each of conductive elements 201 in the mesh pattern and that the ground plane 200 is solid.

Figure 6:
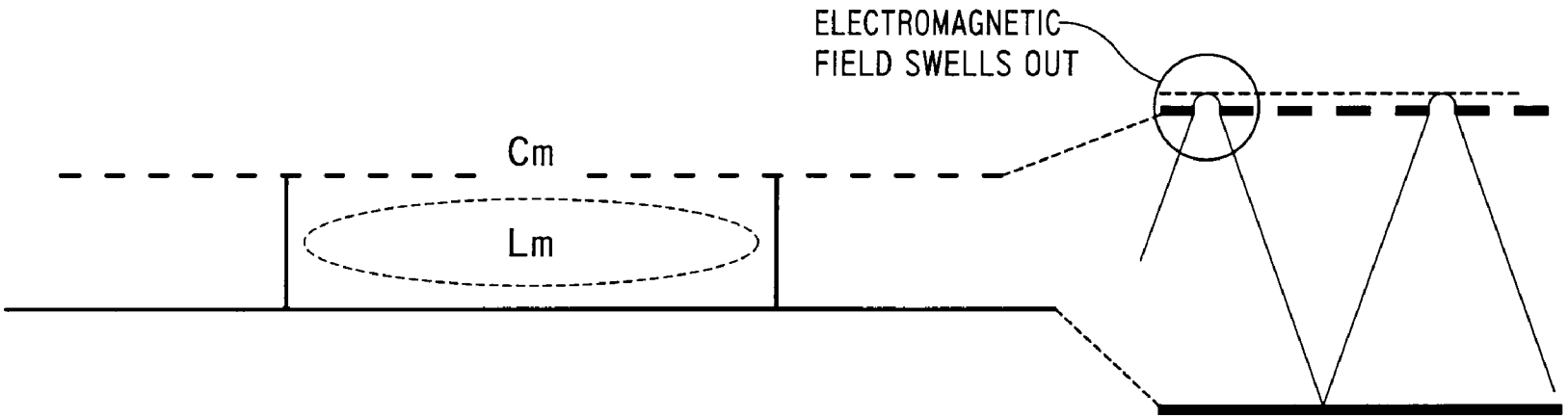
FIG. 6 is a diagram schematically showing a swell-out phenomenon of an electromagnetic field according to a second embodiment.

Also when the openings are formed in the conductive element 201 in the mesh pattern as described above, the thickness of the high-impedance substrate is electromagnetically seen to be effectively thick due to the swell-out phenomenon in the vicinity of the mesh as explained in FIG. 3, and the thinning of the substrate is implemented. FIG. 6 schematically shows the swell-out phenomenon in the electromagnetic field.

Here, in the first embodiment, because of the swell-out phenomenon of the electromagnetic field in a downward direction of the meshed ground plane 100, if an electronic circuit component or the like is placed in the vicinity of or in contact with a lower surface of the ground plane 100, the characteristics of the electronic circuit component or the like is affected, however, the present embodiment has an advantage that the ground plane 200 is solid, and thus, the swell-out phenomenon does not occur in the downward direction of the ground plane 200, so that even when the electronic circuit component or the like is placed in the vicinity of or in contact with the lower surface of the ground plane 200, the characteristics of the high-impedance substrate are not affected in any way.

(Third Embodiment)

Figure 7:
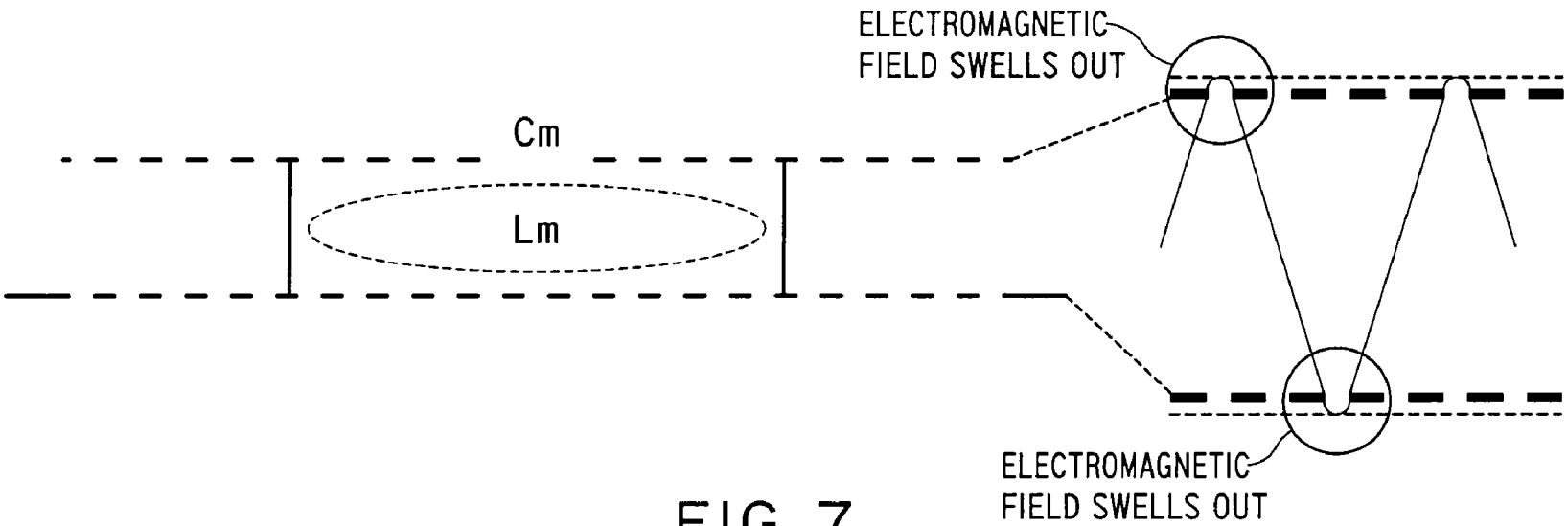
FIG. 7 is a diagram schematically showing a swell-out phenomenon of an electromagnetic field according to a third embodiment.

The present embodiment has a feature in combining the first and the second embodiments. In other words, in the present embodiment, the meshed openings are formed in the ground plane, and also in each of the conductive elements arranged above the ground plane, the meshed openings are formed. As described above, the openings are formed in the mesh pattern both in the ground plane and in each of the conductive elements constituting a high-impedance substrate, whereby the swell-out phenomenon of the electromagnetic field near the mesh becomes prominent, and the structural thinning effect of the high-impedance substrate becomes maximum. FIG. 7 schematically shows a swell-out phenomenon of the electromagnetic field according to the present embodiment.

(Fourth Embodiment)

Figure 8:
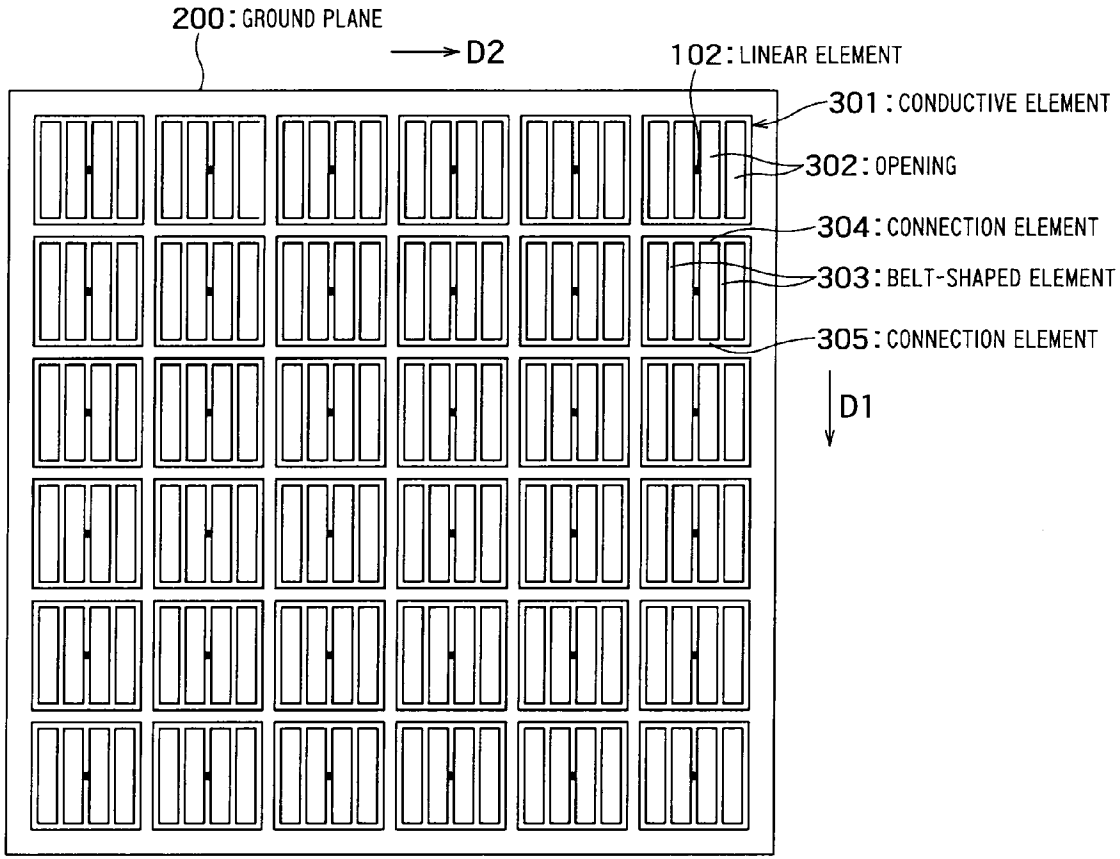
FIG. 8 is a top diagram showing a configuration of a high-impedance substrate according to a fourth embodiment.

FIG. 8 is a top diagram showing a configuration of a high-impedance substrate according to a fourth embodiment of the present invention.

A conductive element 301 of the present embodiment is constituted such that belt-shaped (slit-shaped) openings 302 parallel to a direction D1 which is a longitudinal direction of a matrix are plurally formed in the solid conductive element in a direction D2 (lateral direction of the matrix) orthogonal to the direction D1 at a constant interval. In other words, one ends of the plural belt-shaped elements 303 parallel to the direction D1 are commonly connected by a first connection element 304 parallel to the direction D2, whereas another ends are commonly connected by a second connection element 305 parallel to the direction D2. The belt-shaped element 303 is adjacent to the belt-shaped opening 302. The belt-shaped opening 302 reflects a radio wave reflected on the ground plane 200 toward the ground plane 200. The ground plane 200 is the solid metal plate similar to that in the second embodiment, however, may adopt the ground plane 100 where the openings are formed in the mesh pattern.

By plurally forming the belt-shaped openings 302 in the conductive element in the direction D2 as described above, in addition to the swell-out phenomenon of the electromagnetic field, a restriction of a current path flowing in the conductive element is strengthened in the direction D1, and an inductance component L as expressed by an equivalent circuit is increased, thereby making it possible to increase the effect of the band broadening. However, in this case, the high-impedance characteristics in the direction D2 are lost.

(Fifth Embodiment)

Figure 9:
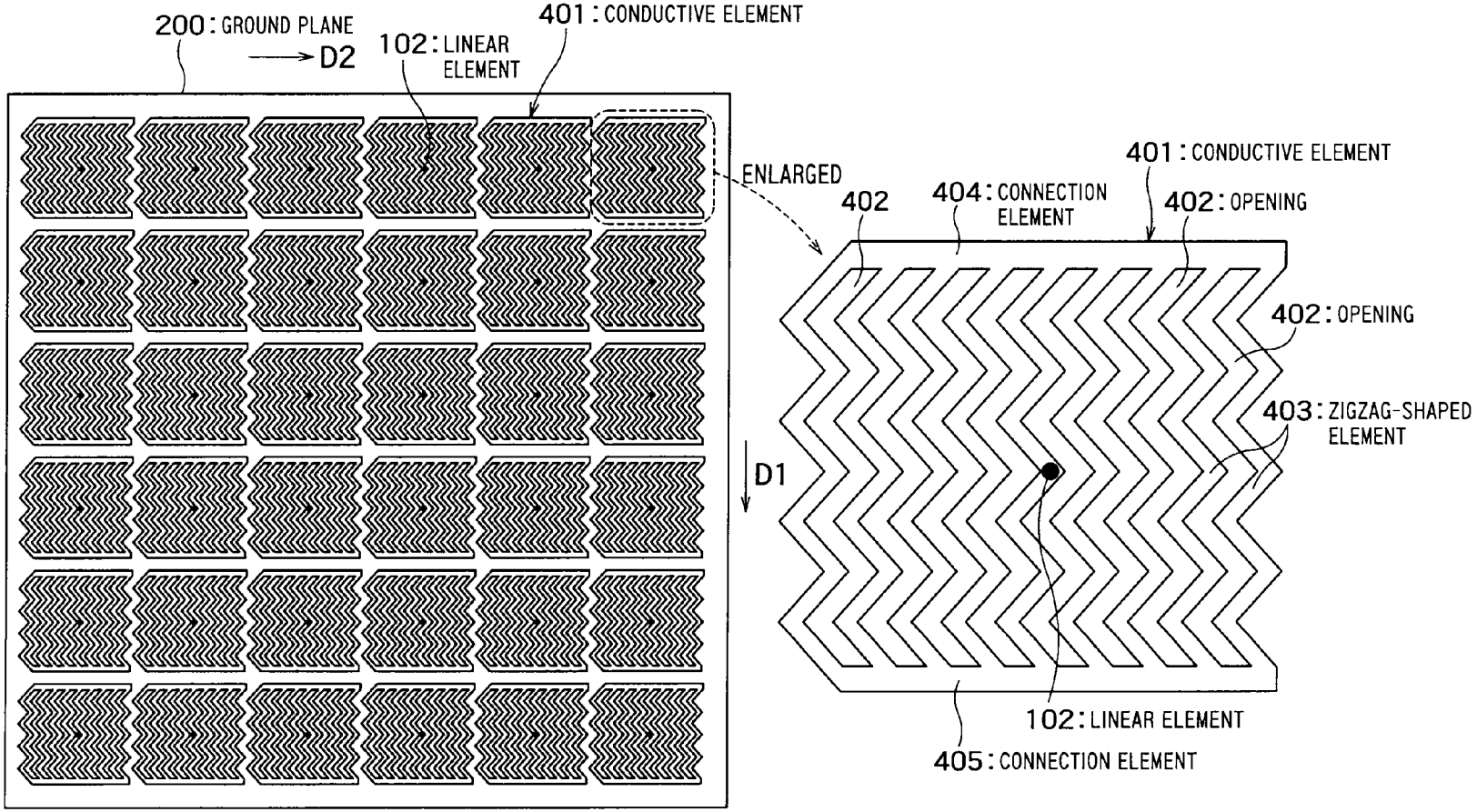
FIG. 9 is a top diagram showing a configuration of a high-impedance substrate according to a fifth embodiment.

FIG. 9 is a top diagram showing a configuration of a high-impedance substrate according to a fifth embodiment of the present embodiment. This fifth embodiment has a feature in changing a shape of the belt-shaped opening according to the fourth embodiment to a zigzag shape.

As shown in FIG. 9, a conductive element 401 of the present embodiment is constituted such that a plurality of zigzag-shaped openings 402 parallel to the direction D1 of a matrix are plurally formed in the direction D2 in the solid conductive element. In other words, the zigzag-shaped elements 403 parallel to the direction D1 are plurally formed in the direction D2 at a constant interval, and one ends of the zigzag-shaped elements 403 are commonly connected by a first connection element 404 parallel to the direction D2, whereas another ends are commonly connected by a second connection element 405. The zigzag-shaped opening 402 is adjacent to the zigzag-shaped element 403. The zigzag-shaped opening 402 reflects the radio wave reflected on the ground plane 200 toward the ground plane 200.

The ground plane 200 is the solid metal plate similar to that in the second embodiment, however, may adopt the ground plane 100 where the openings are formed in the mesh pattern.

The openings in the conductive element 401 are formed in a zigzag manner as described above, whereby the current path flowing in the conductive element 401 is extended compared with the fourth embodiment, so that it is possible to downsize the conductive element which is a unit cell constituting a periodic structure of the high-impedance substrate.

(Sixth Embodiment)

Figure 10:
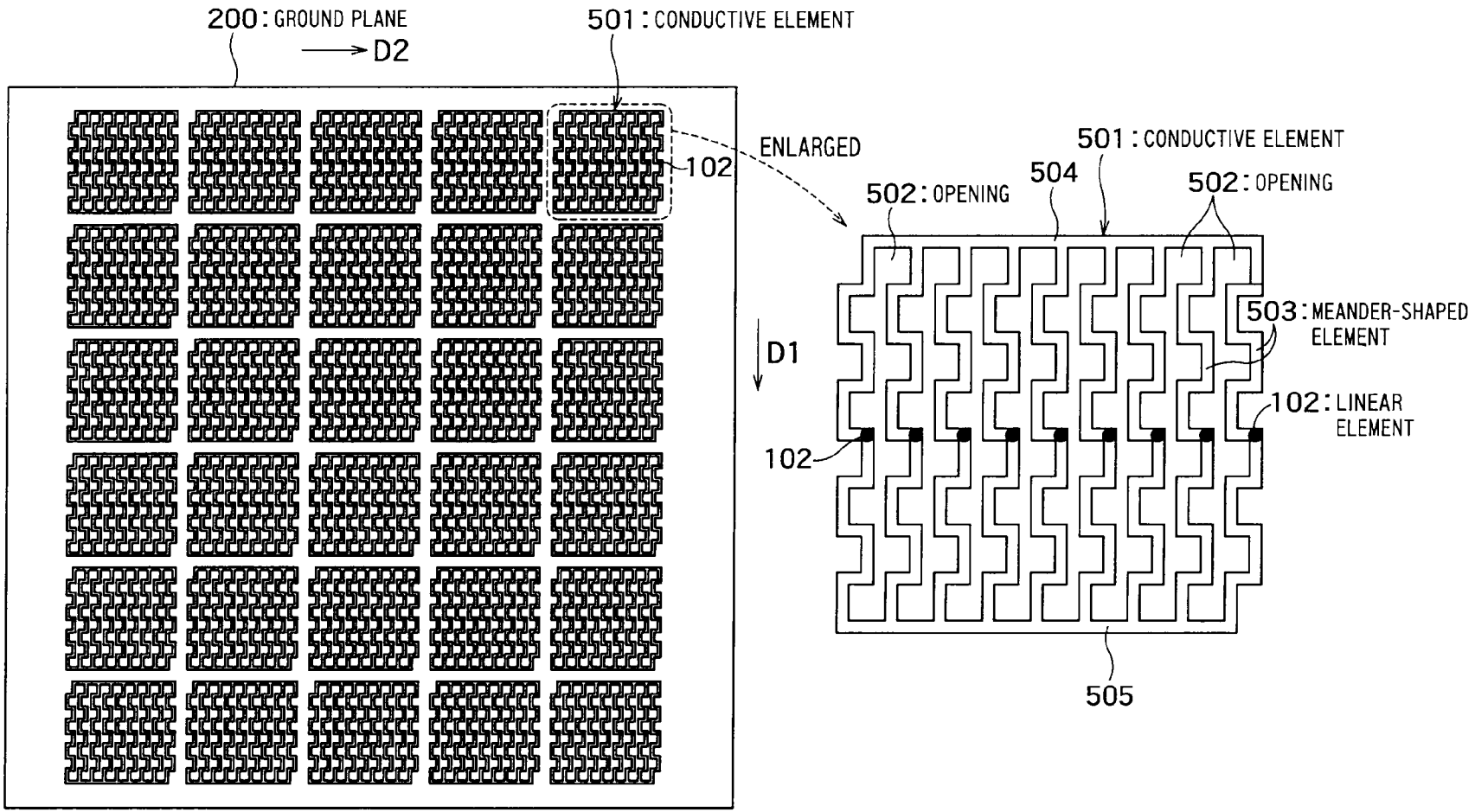
FIG. 10 is a top diagram showing a configuration of a high-impedance substrate according to a sixth embodiment.

FIG. 10 is a top diagram showing a configuration of a high-impedance substrate according to a sixth embodiment. This sixth embodiment has a feature in that the shape of the belt-shaped opening in the fourth embodiment is changed to a meander shape and the linear elements 102 are connected to each meander-shaped element adjacent to the meander-shaped openings for each of the conductive elements.

As shown in FIG. 10, a conductive element 501 of the present embodiment is constituted such that meander-shaped openings 502 parallel to the direction D1 of a matrix are plurally formed in the direction D2 in the solid conductive element. In other words, meander-shaped elements 503 parallel to the direction D1 are plurally formed in the direction D2, and one ends of the meander-shaped elements 503 are commonly connected by a first connection element 504 parallel to the direction D2, whereas another ends are commonly connected by a second connection element 505 parallel to the direction D2. And, the linear element 102 is connected to each of the meander-shaped elements 503.

The ground plane 200 is the solid metal plate similar to that in the second embodiment, however, may adopt the ground plane 100 where the openings are formed in the mesh pattern.

An effect similar to that in the fifth embodiment is obtained by forming the shape of the opening of the conductive element in a meander manner, and the current path flowing in the conductive element 501 is multiple-lined by connecting the linear element 102 to each of the meander-shaped elements 503 (in other words, generated are a number of combinations of the linear elements between the adjacent conductive elements). This enables to generate multiple resonance due to diversification of the inductance component L as expressed by the equivalent circuit, and then, to increase the effect of the band broadening. It is to be noted that in the fourth or the fifth embodiment shown in FIG. 8 or 9, the effect similar to that in the present sixth embodiment can be obtained also by connecting the linear element 102 to all of the belt-shaped elements or the zigzag-shaped elements.

(Seventh Embodiment)

Figure 11:
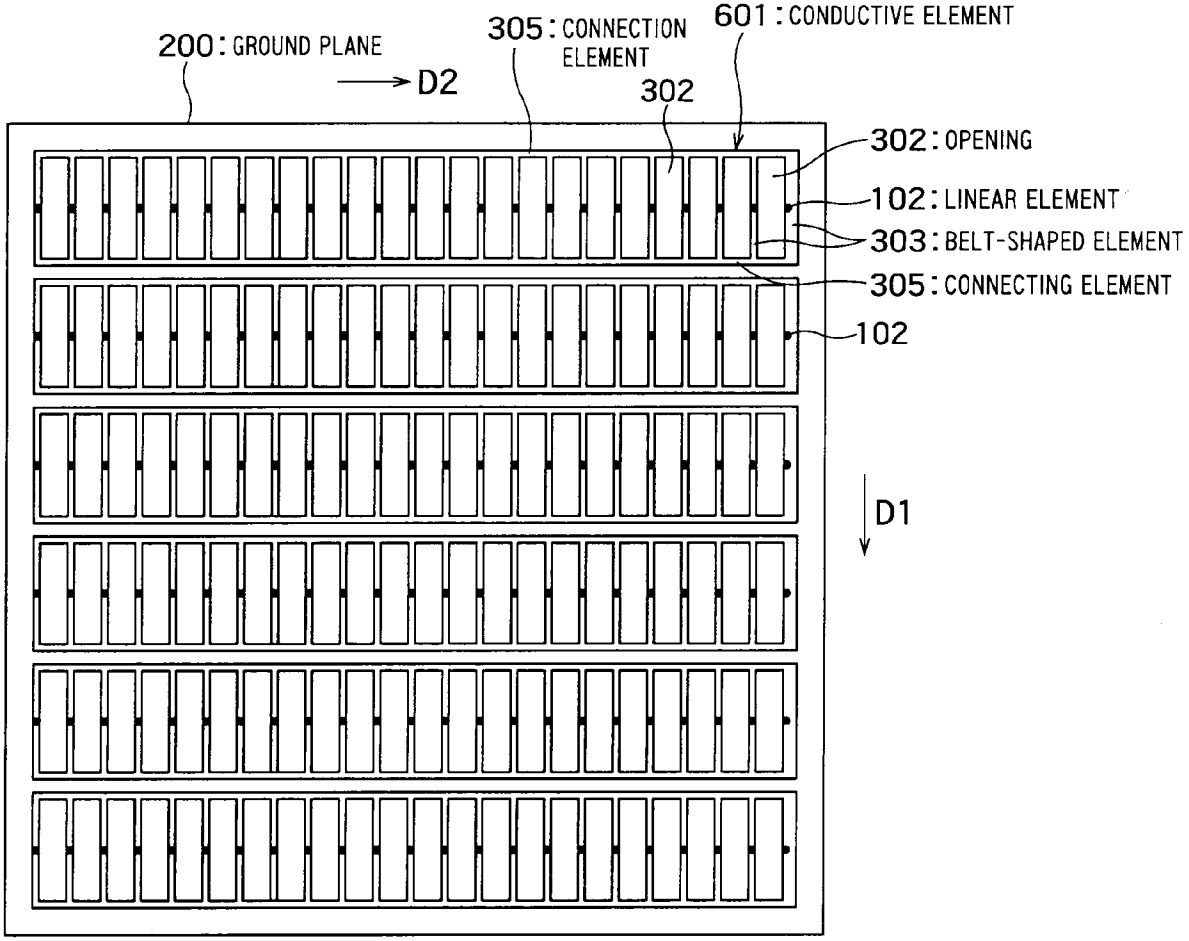
FIG. 11 is a top diagram showing a configuration of a high-impedance substrate according to a seventh embodiment.

FIG. 11 is a top diagram showing a configuration of a high-impedance substrate according to a seventh embodiment of the present invention.

This high-impedance substrate is a variation of the high-impedance substrate shown in the fourth embodiment (refer to FIG. 8). In FIG. 8, the square conductive elements are arranged in the matrix pattern of 6 rows×6 columns, however, in the present embodiment, conductive elements 601 are arranged in a matrix pattern of 6 rows×1 column, and each of the conductive elements is constituted so as to have a laterally-long, rectangular shape. Each of the belt-shaped elements 303 in one conductive element 601 is connected to the ground plane 200 via the linear element 102. In other words, the present embodiment is configured such that the conductive elements in the direction D2, having lost the high-impedance characteristics in FIG. 8, are got together to be connected with each other and all of the belt-shaped elements in one conductive element are connected to the ground plane via the linear elements 102.

The ground plane 200 is the solid metal plate similar to that in the second embodiment, however, may adopt the ground plane 100 where the openings are formed in the mesh pattern.

As described above, a lateral width of the conductive element is broadened and a number of the linear elements 102 are arranged, thereby allowing to further increase the effect of the band broadening.

(Eighth Embodiment)

Figure 12A:
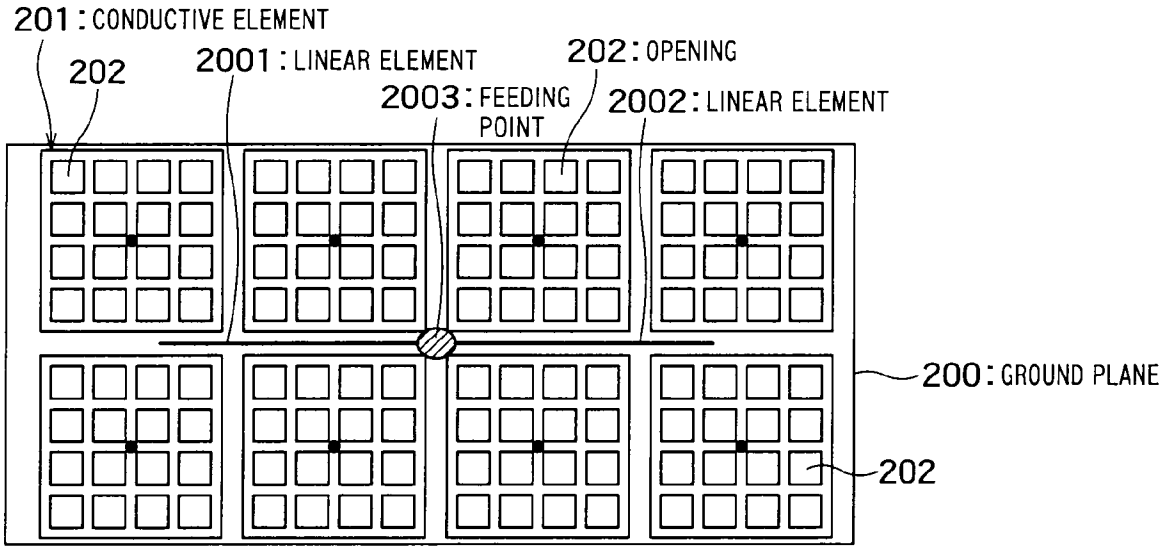
FIGS. 12A and 12B are a diagram showing a configuration of an antenna apparatus and a wireless communication device according to an eighth embodiment.
Figure 12B:
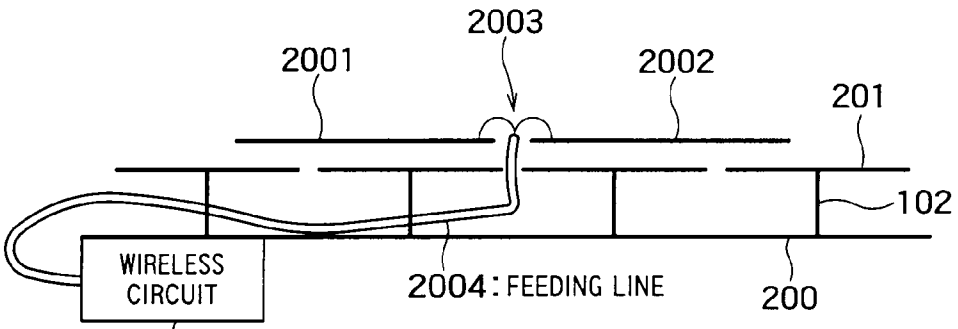

FIGS. 12A and 12B show a configuration of an antenna apparatus and a wireless communication device according to an eighth embodiment of the present invention. FIG. 12A is a top diagram, whereas FIG. 12B is a side diagram.

This antenna apparatus has a configuration in which the high-impedance substrate according to the second embodiment and a dipole-type antenna are combined together The dipole antenna including linear elements 2001, 2002 and a feeding point 2003 is placed above the high-impedance substrate according to the second embodiment. The feeding point 2003 is a connection point with a feeding line 2004. The length of the dipole antenna (total length of the linear elements 2001, 2002) is almost one-half wavelength of the operational frequency. The dipole antenna is placed on a gap line between two rows of the conductive elements, whereas the feeding point 2004 is placed at an intersection of the gap lines orthogonal to each other. A wireless circuit 2005 for generating a high-frequency current is connected to the feeding line 2004.

When the feeding line 2004 feeds via the feeding point 2003 the high-frequency current having the above-mentioned operational frequency, the dipole antenna resonates to radiate the radio wave of the use wavelength into a space. As described above, because of the swell-out phenomenon of the electromagnetic field from the meshed openings 202 in the conductive element 201, the thickness of the high-impedance substrate is seen to be greater than that of an actual one, so that the thinned antenna apparatus can be implemented. The ground plane 200 is the solid metal plate, and thus, the swell-out phenomenon in the downward direction of the ground plane 200 does not occur. Therefore, as described above, even when the electronic circuit component or the like is placed in the close vicinity of or in contact with the lower surface of the ground plane 200, the characteristics of the high-impedance substrate and of the mounted antenna are not affected in any way, so that the configuration in FIG. 12 is suitable for a thinned built-in antenna of a small-sized wireless terminal.

Here, shown is the example in which the high-impedance substrate according to the second embodiment is combined with the dipole antenna, however, it is deservingly possible also to combine the high-impedance substrates according to the first, the third to the seventh embodiments with the dipole antenna.

For example, when using the high-impedance substrate according to the third embodiment, the meshed openings are formed both in the ground plane and in a group of the conductive elements, and the swell-out phenomenon of the electromagnetic field near the mesh becomes further prominent. Consequently, the structural thinning effect of the high-impedance substrate becomes maximum, so that an antenna apparatus in which the high-impedance substrate according to the third embodiment is combined with the dipole antenna is suitable for a built-in antenna of a thinned wireless terminal whose installation space is limited.

Figure 13A:
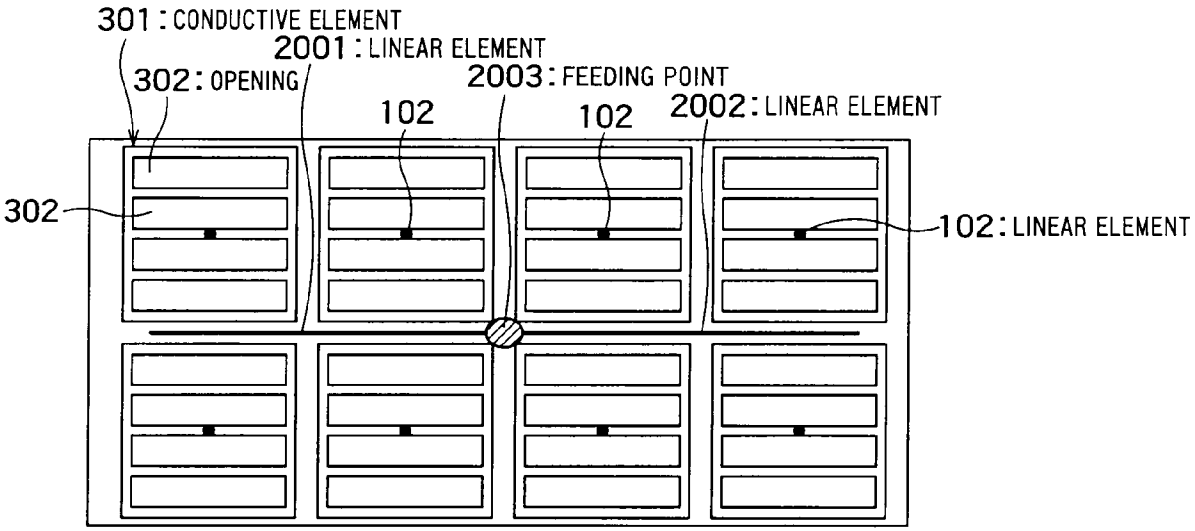
FIGS. 13A and 13B show an example of an antenna apparatus and a wireless communication device in which the high-impedance substrate according to the fourth embodiment is combined with a dipole antenna.
Figure 13B:
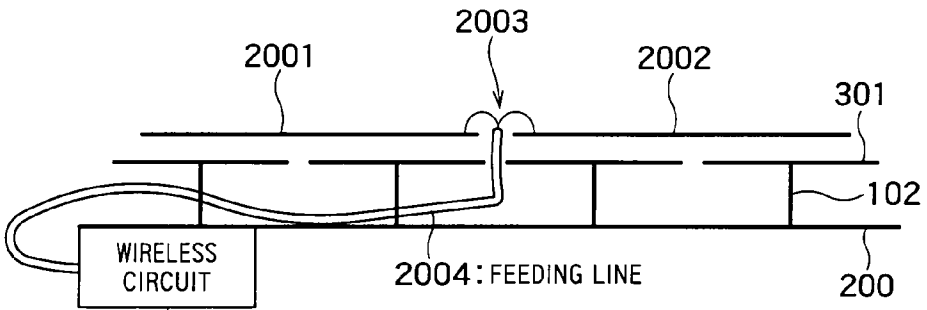

In addition, FIG. 13 shows an example of an antenna apparatus and the wireless communication device in which the high-impedance substrate according to the fourth embodiment is combined with the dipole antenna. FIG. 13A is a top diagram, whereas FIG. 13B is a side diagram. The dipole antenna is placed on the gap line along a longer direction of the slits of the conductive elements (a shorter direction has lost the high-impedance characteristics). In this configuration, an effect similar to that in FIG. 12 is obtained, and also the increase in the inductance component L makes it possible to thin the high-impedance substrate, so that further thinning of the antenna apparatus can be implemented.

(Ninth Embodiment)

Figure 14A:
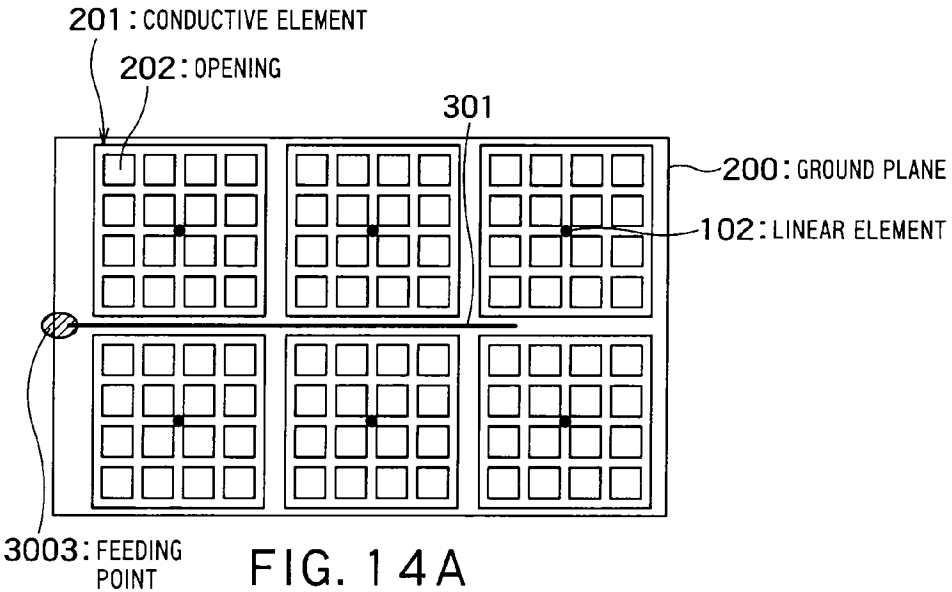
FIGS. 14A and 14B show an example of an antenna apparatus and a wireless communication device according to a ninth embodiment.
Figure 14B:
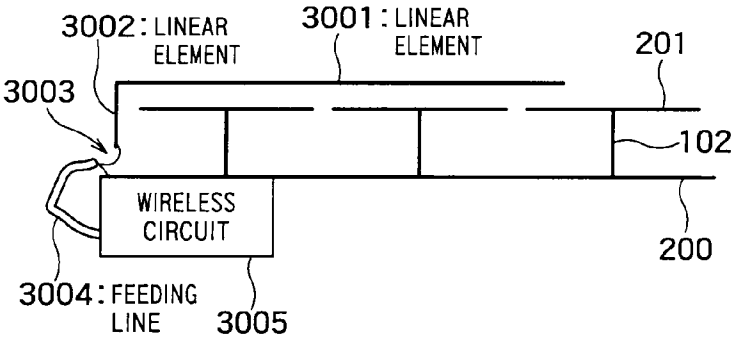

FIG. 14 shows an example of an antenna apparatus and a wireless communication device according to a ninth embodiment. FIG. 14A is a top diagram, whereas FIG. 14B is a side diagram.

This antenna apparatus has a structure in which the high-impedance substrate according to the second embodiment is combined with a monopole-type antenna. The antenna apparatus is more downsized compared with the eighth embodiment shown in FIG. 12.

The monopole antenna is formed by a linear element 3001 substantially parallel to the ground plane 200 and a linear element 3002 substantially vertical to the ground plane 200. One end of the linear element 3002 is substantially vertically connected to one end of the linear element 3001, whereby the monopole antenna forms an L-shape in a whole. The length of the monopole antenna (total length of the linear elements 3001, 3002) is almost one-quarter wavelength of the operational frequency, whereas the length of the linear element 3002 is same as or somewhat longer than that of the linear element 102.

Another end of the linear element 3002 is connected to a feeding point 3003. The feeding point 3003 is the connection point with a feeding line 3004. Here, the feeding line 3004 is formed of a coaxial line. An outer conductor of the feeding line 3004 is connected to the ground plane 200, whereas an inner conductor is connected to the linear element 3002. The monopole antenna allows to satisfactorily radiate the radio wave by flowing the current in the ground plane, so that the feeding point 3003 of the monopole antenna is located at an end of the ground plane 200, whereby the current is flown in a circumference of the ground plane 200 (an end side of the ground plane 200), that is, a portion where the high-impedance characteristics by means of the conductive element 201 and the linear element 102 do not appear, and the radio wave is radiated. A wireless circuit 3005 for generating the high-frequency current is connected to the feeding line 3004.

In the configuration in FIGS. 14A and 14B, the thickness of the high-impedance substrate is electromagnetically seen to be greater than that of the actual one due to the swell-out phenomenon of the electromagnetic field from the meshed openings of the conductive element 201 as describe above, so that the thinned antenna apparatus can be implemented. The ground plane 200 is the solid metal plate, and thus, the swell-out phenomenon in the downward direction of the ground plane 200 does not occur. Therefore, as described above, even when the electronic circuit component or the like is placed in the close vicinity of or in contact with the lower surface of the ground plane 200, the characteristics of the high-impedance substrate and of the mounted antenna are not affected in any way, so that the configuration in FIGS. 14A and 14B is suitable for the thinned built-in antenna of the small-sized wireless terminal.

Here, shown is the example in which the high-impedance substrate according to the second embodiment is combined with the monopole antenna, however, it is deservingly possible also to combine the high-impedance substrates according to the first, the third to the seventh embodiments with the monopole antenna.

For example, when using the high-impedance substrate according to the third embodiment, the meshed openings are formed both in the ground plane 200 and in a group of the conductive elements 201, and the swell-out phenomenon of the electromagnetic field near the mesh becomes further prominent. Therefore, the structural thinning effect of the high-impedance substrate becomes maximum, so that an ultra-thin antenna can be implemented. Consequently, the antenna apparatus in which the high-impedance substrate according to the third embodiment is combined with the monopole antenna is suitable for the built-in antenna of the thinned wireless terminal whose installation space is limited.

Figure 15A:
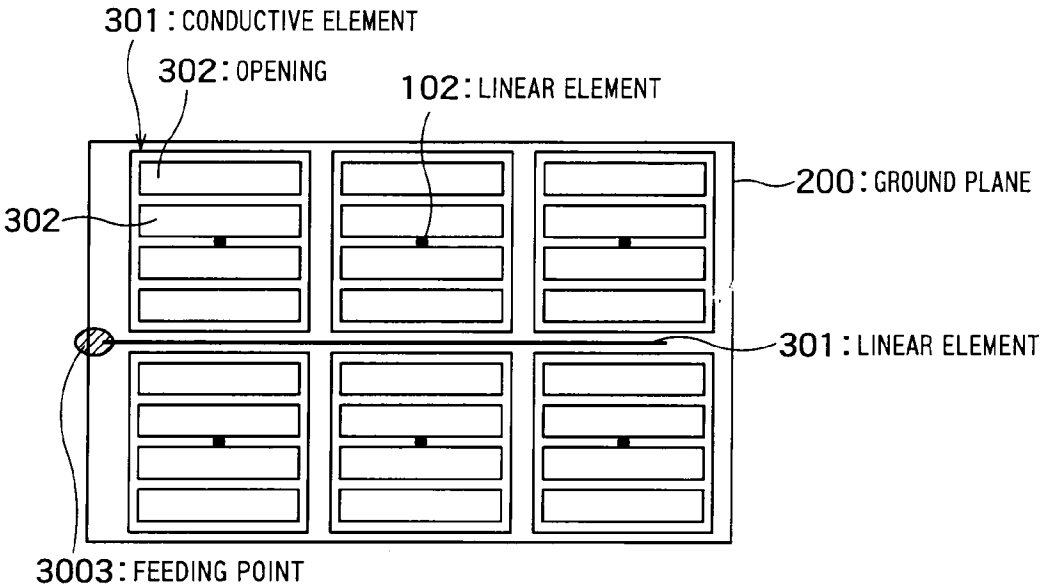
FIGS. 15A and 15B show an example of the antenna apparatus and the wireless communication device in which the high-impedance substrate according to the fourth embodiment is combined with a monopole antenna.
Figure 15B:
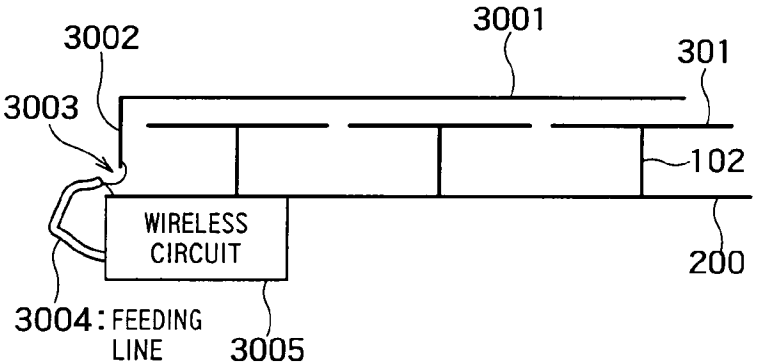

In addition, FIGS. 15A and 15B show an example of an antenna apparatus and the wireless communication device in which the high-impedance substrate according to the fourth embodiment is combined with the monopole antenna. FIG. 15A is a top diagram, whereas FIG. 15B is a side diagram. The monopole antenna 3001 is placed on the gap line along the longer direction of the belt-shaped openings (slits) 302 of the conductive elements 301 (the shorter direction has lost the high-impedance characteristics). In this configuration, an effect similar to that in FIG. 14 is obtained, and also the increase in the inductance component L makes it possible to thin the high-impedance substrate, so that the further thinning of the antenna apparatus can be implemented.

Industrial Applicability

The present invention can also be applied to wireless communication typified by a wireless terminal such as a cellular phone or a PC (Personal Computer) using wireless LAN (Local Area Network) or to an antenna for receiving terrestrial digital broadcasting, or in addition thereto, an antenna for a radar. The present invention is suitable especially for an antenna to be placed on a surface of a mobile especially requiring thinning. Moreover, the present invention is superior also in adaptability to a curved-surface structure, and can be applied to, what is called, a conformal antenna.

The present invention is not limited to the exact embodiments described above and can be embodied with its components modified in an implementation phase without departing from the scope of the invention. Also, arbitrary combinations of the components disclosed in the above-described embodiments can form various inventions. For example, some of the all components shown in the embodiments may be omitted. Furthermore, components from different embodiments may be combined as appropriate.

What is claimed is:

1. An antenna apparatus comprising:

a ground plane;

a plurality of conductive elements arranged substantially in parallel to a surface of the ground plane;

a plurality of linear elements configured to connect the conductive elements to the ground plane; and an antenna configured to radiate a radio wave, wherein a first plurality of openings to reflect the radio wave radiated from the antenna are formed in the ground plane under an arrangement region of the conductive elements, a second plurality of openings to further reflect the radio wave reflected on the ground plane toward the ground plane are formed in the conductive elements, the second openings in the conductive elements are belt-shaped openings, the belt-shaped openings in the conductive elements are parallel to a first direction which is one of a longitudinal direction and a lateral direction and arranged at a predetermined interval in a second direction which is the other of the longitudinal direction and the lateral direction; and a length direction of the antenna is coincident with the first direction.

2. The apparatus according to claim 1, wherein the linear elements are connected to belt-shaped element portions adjacent to the belt-shaped openings in each of the conductive elements.

3. A wireless communication device, comprising:

an antenna apparatus according to claim 1;

a feeding line connected to a feeding point of the antenna in the antenna apparatus; and a wireless circuit configured to supply a current to the antenna via the feeding line.

4. An antenna apparatus comprising:

a ground plane;

a plurality of conductive elements arranged substantially in parallel to a surface of the ground plane;

a plurality of linear elements configured to connect the conductive elements to the ground plane; and an antenna configured to radiate a radio wave, wherein a plurality of first openings to reflect the radio wave radiated from the antenna are formed in the ground plane under an arrangement region of the conductive elements, a plurality of second openings to further reflect the radio wave reflected on the ground plane toward the ground plane are formed in the conductive elements, the second openings in the conductive elements are zigzag-shaped openings the zigzag-shaped openings in the conductive elements are parallel to a first direction which is one of a longitudinal direction and a lateral direction and arranged at a predetermined interval in a second direction which is the other of the longitudinal direction and the lateral direction; and a length direction of the antenna is coincident with the first direction.

5. The apparatus according to claim 4, wherein the linear elements are connected to zigzag-shaped element portions adjacent to the zigzag-shaped openings in each of the conductive elements.

6. An antenna apparatus comprising:

a ground plane;

a plurality of conductive elements arranged substantially in parallel to a surface of the ground plane;

a plurality of linear elements configured to connect the conductive elements to the ground plane; and an antenna configured to radiate a radio wave, wherein a plurality of first openings to reflect the radio wave radiated from the antenna are formed in the ground plane under an arrangement region of the conductive elements, a plurality of second openings to further reflect the radio wave reflected on the ground plane toward the ground plane are formed in the conductive elements, the second openings in the conductive elements are meander-shaped openings the meander-shaped openings in the conductive elements are parallel to a first direction which is one of a longitudinal direction and a lateral direction and arranged at a predetermined interval in a second direction which is the other of the longitudinal direction and the lateral direction; and a length direction of the antenna is coincident with the first direction.

7. The apparatus according to claim 6, wherein the linear elements are connected to meander-shaped element portions adjacent to the meander-shaped openings in each of the conductive elements.

8. An antenna apparatus comprising:

a ground plane;

a plurality of conductive elements arranged substantially in parallel to a surface of the ground plane;

a plurality of linear elements configured to connect the conductive elements to the ground plane; and an antenna configured to radiate a radio wave, wherein a plurality of openings to reflect the radio wave radiated from the antenna toward the ground plane are formed in each of the conductive elements.

9. The apparatus according to claim 8, wherein the openings are arranged in a mesh pattern.

10. The apparatus according to claim 8, wherein the conductive elements are arranged in a matrix pattern;

the openings are belt-shaped openings, the belt-shaped openings are parallel to a first direction which is one of a longitudinal direction and a lateral direction of the matrix and arranged at a predetermined interval in a second direction which is the other of the longitudinal direction and the lateral direction; and a length direction of the antenna is coincident with the first direction.

11. The apparatus according to claim 10, wherein the linear elements are connected to belt-shaped element portions adjacent to the belt-shaped openings in each of the conductive elements.

12. The apparatus according to claim 8, wherein the conductive elements are arranged in a matrix pattern;

the openings are zigzag-shaped openings the zigzag-shaped openings are parallel to a first direction which is one of a longitudinal direction and a lateral direction of the matrix and arranged at a predetermined interval in a second direction which is the other of the longitudinal direction and the lateral direction; and a length direction of the antenna is coincident with the first direction.

13. The apparatus according to claim 12, wherein the linear elements are connected to zigzag-shaped element portions adjacent to the zigzag-shaped openings in each of the conductive elements.

14. The apparatus according to claim 8, wherein the conductive elements are arranged in a matrix pattern;

the openings are meander-shaped openings the meander-shaped openings are parallel to a first direction which is one of a longitudinal direction and a lateral direction of the matrix and arranged at a predetermined interval in a second direction which is the other of the longitudinal direction and the lateral direction; and a length direction of the antenna is coincident with the first direction.

15. The apparatus according to claim 14, wherein the linear elements are connected to meander-shaped element portions adjacent to the meander-shaped openings in each of the conductive elements.

16. A wireless communication device, comprising:

an antenna apparatus according to claim 8;

a feeding line connected to a feeding point of the antenna in the antenna apparatus; and a wireless circuit configured to supply a current to the antenna via the feeding line.

* * * * *